United States Patent [19]

Wachs et al.

[11] Patent Number: 4,483,106

[45] Date of Patent: Nov. 20, 1984

[54] WELD SANDER

[75] Inventors: Edward H. Wachs; Ingval Johansson, both of Lake Forest, Ill.

[73] Assignee: The E. H. Wachs Company, Wheeling, Ill.

[21] Appl. No.: 357,831

[22] Filed: Mar. 12, 1982

[51] Int. Cl.[3] ..... B24B 19/26; B24B 21/02; B24B 23/08

[52] U.S. Cl. ..... 51/241 S; 51/147

[58] Field of Search ..... 51/241 S, 170 EB, 135 R, 51/147

[56] References Cited

U.S. PATENT DOCUMENTS 3,608,246 9/1971 McCormack et al. ..... 51/174
4,269,552 5/1981 Unigovsky et al. ..... 409/140

FOREIGN PATENT DOCUMENTS 2424100 12/1979 France ..... 51/147
43389 4/1979 Japan ..... 51/241 S
512039 7/1976 U.S.S.R. ..... 51/241 S
704753 12/1979 U.S.S.R. ..... 51/241 S

OTHER PUBLICATIONS

Portions of a brochure of E. H. Wachs Company.

*Primary Examiner*—Roscoe V. Parker
*Attorney, Agent, or Firm*—Wood, Dalton, Phillips, Mason & Rowe

[57] ABSTRACT

A weld sander for smoothing the surface of a weld which joins lengths of pipe. The weld sander has a carriage which travels around the pipe and movably mounts a head carrying a grinding belt, with the belt mounted for movement toward and away from the weld and also for tilting movement. Pipe followers, associated with the head, control the minimum distance of the belt from the pipe sections and, additionally, establish a minimum distance between an edge of the belt and a pipe to prevent engagement between the belt and a pipe when the belt tilts.

6 Claims, 6 Drawing Figures

45
48
61
61
60
71
73
69
72
68
50
110
115
74
67
100
111
112
102
115
55
53
54
101
52
46
51
104
103
47
10
12
11

WELD SANDER

BACKGROUND OF THE INVENTION

This invention pertains to a weld sander operable to smooth the surface of a weld cap of a weld joint between pipes and which does not have any abrasive contact with the pipe surfaces adjacent the weld.

In the nuclear industry, it is frequently necessary to verify the adequacy of a weld between sections of pipe. The weld check system requires a smooth weld surface in order that the energy waves generated by a system component properly enter into the weld. Previously, there has not been a machine which, after initial set-up, could automatically travel around the pipe and smooth the surface of the weld, taking into account any misalignment in the fit-up of the pipe sections resulting from out-of-roundness of the pipe sections and without any undercutting of the surfaces of the pipe sections. It is important that the grinding belt used to smooth the surface of the weld not touch the outside surfaces of the pipe sections,to avoid any possibility of setting up stress problems in the pipe and reducing the required minimum wall thickness of the pipe.

SUMMARY OF THE INVENTION

A primary feature of the invention is to provide a weld sander which can be mounted on a pipe and which operates automatically to smooth the surface of a circumferential weld during travel around the pipe and without any abrasive contact with pipe surfaces at either side of the weld.

More particularly, the weld sander has a carriage which can travel circumferentially around the pipe and a grinding belt is associated with the carriage for engagement with the surface of the weld for smoothing thereof. The grinding belt is mounted relative to the carriage for movement toward and away from the weld as well as for tilting movement and followers are operable to control the minimum distance of the belt from the pipe section at either side of the weld and prevent a belt edge contacting the surface of a pipe section when the belt tilts.

DESCRIPTION OF THE PREFERRED EMBODIMENT

Figure 1:
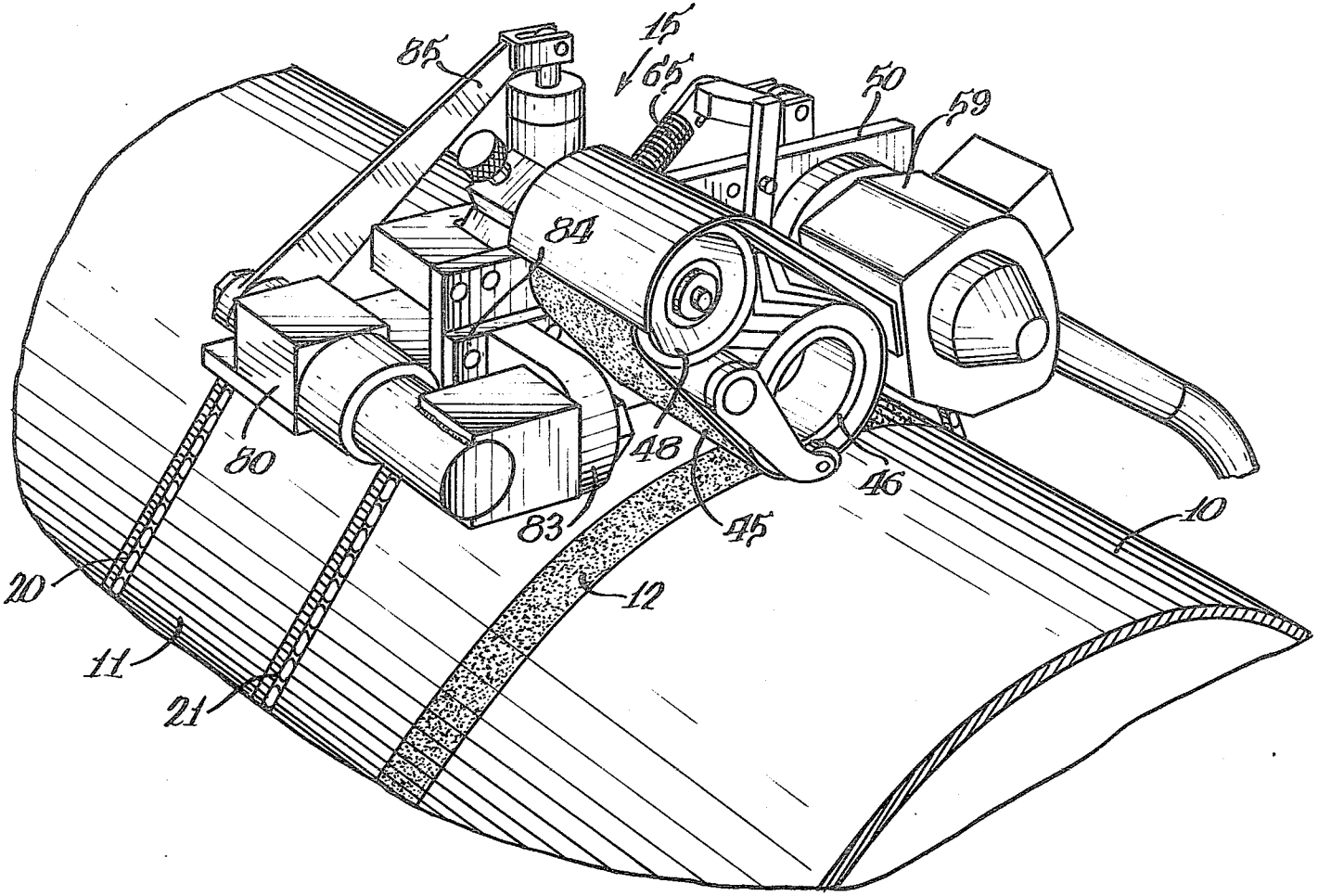
FIG. 1 is a perspective view of the weld sander looking toward the front thereof and shown in association with a pair of pipe sections welded together in end-to-end relation.
Figure 2:
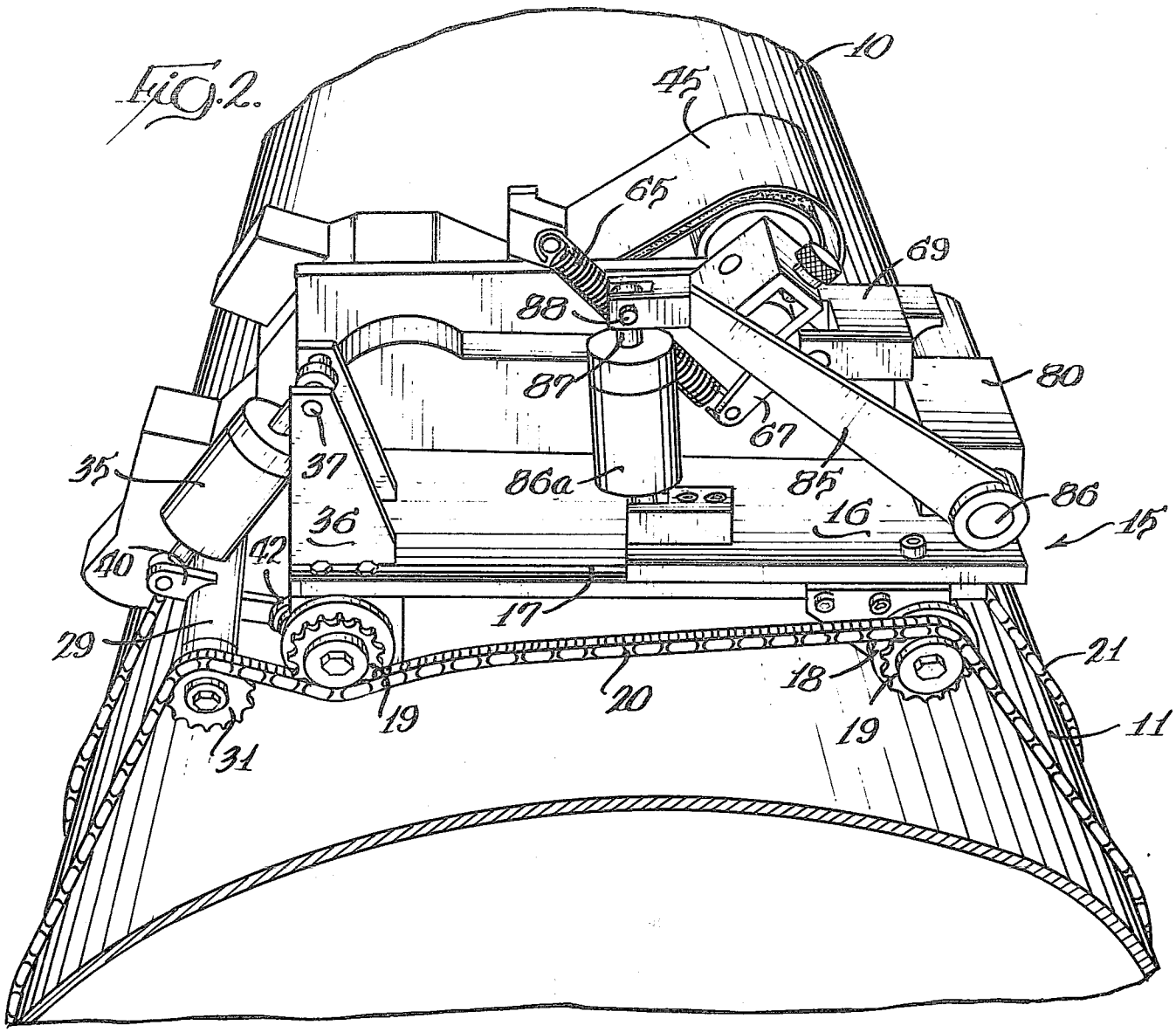
FIG. 2 is a perspective view of the weld sander shown in association with adjacent pipe sections and looking toward the rear thereof.

The weld sander is best seen as to its general features of construction in FIGS. 1 and 2 wherein the weld sander is associated with a pair of pipes or pipe sections 10 and 11 which are joined together in end-to-end relation by a weld 12.

Figure 3:
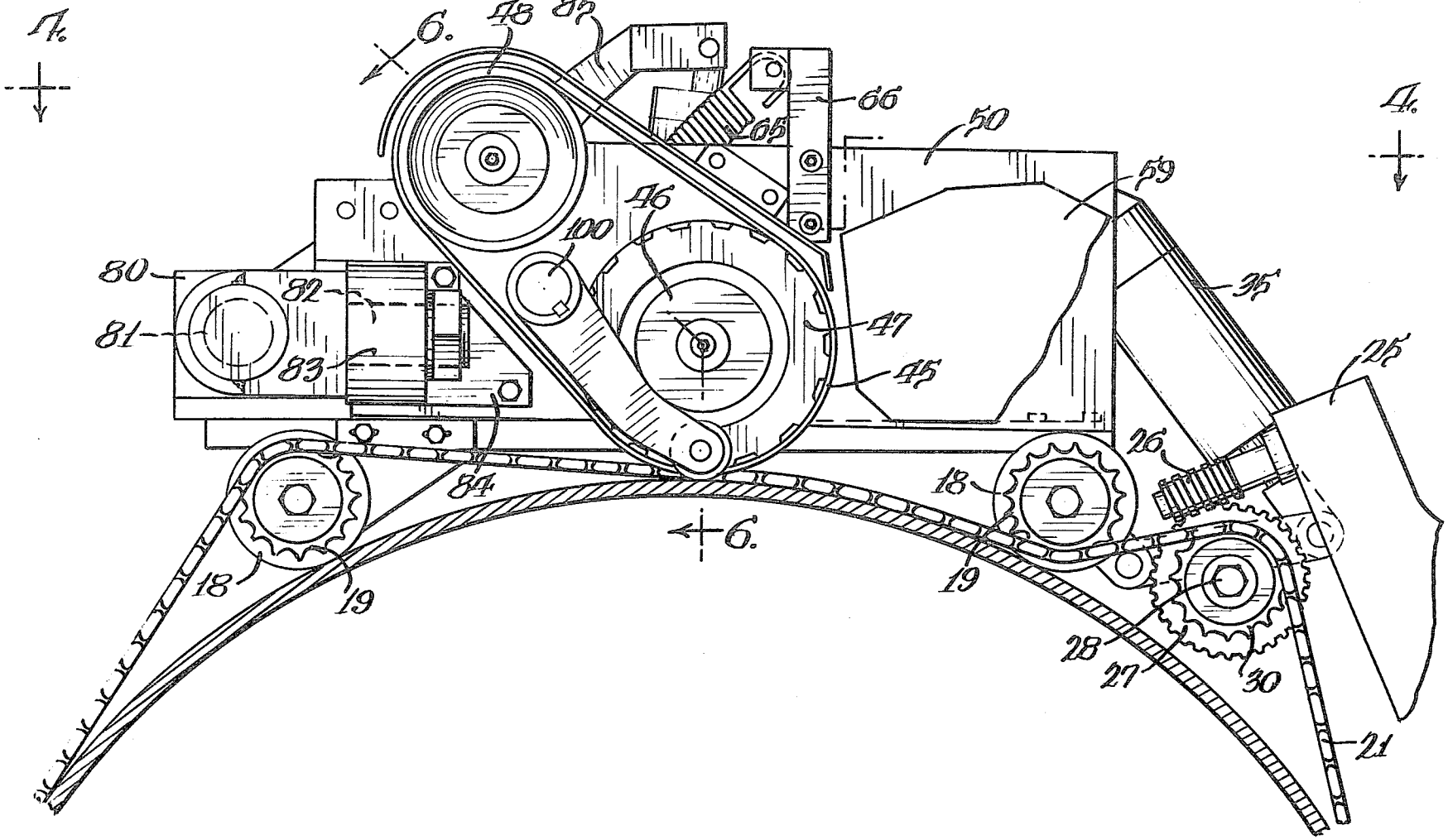
FIG. 3 is a side elevational view of the weld sander shown in association with the pipes.
Figure 4:
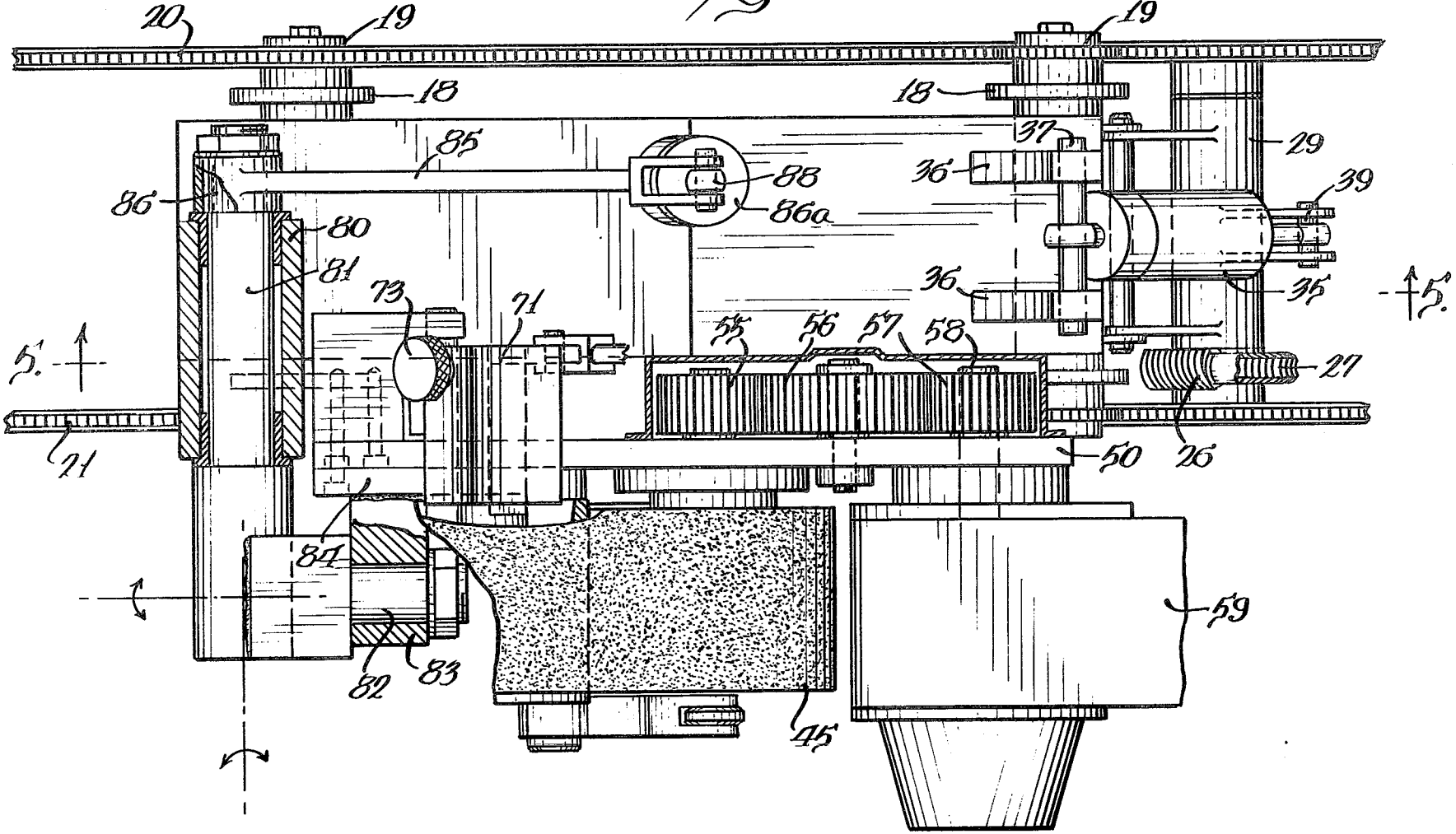
FIG. 4 is a plan section, taken generally along the line 4—4 in FIG. 3 and with parts broken away.
Figure 5:
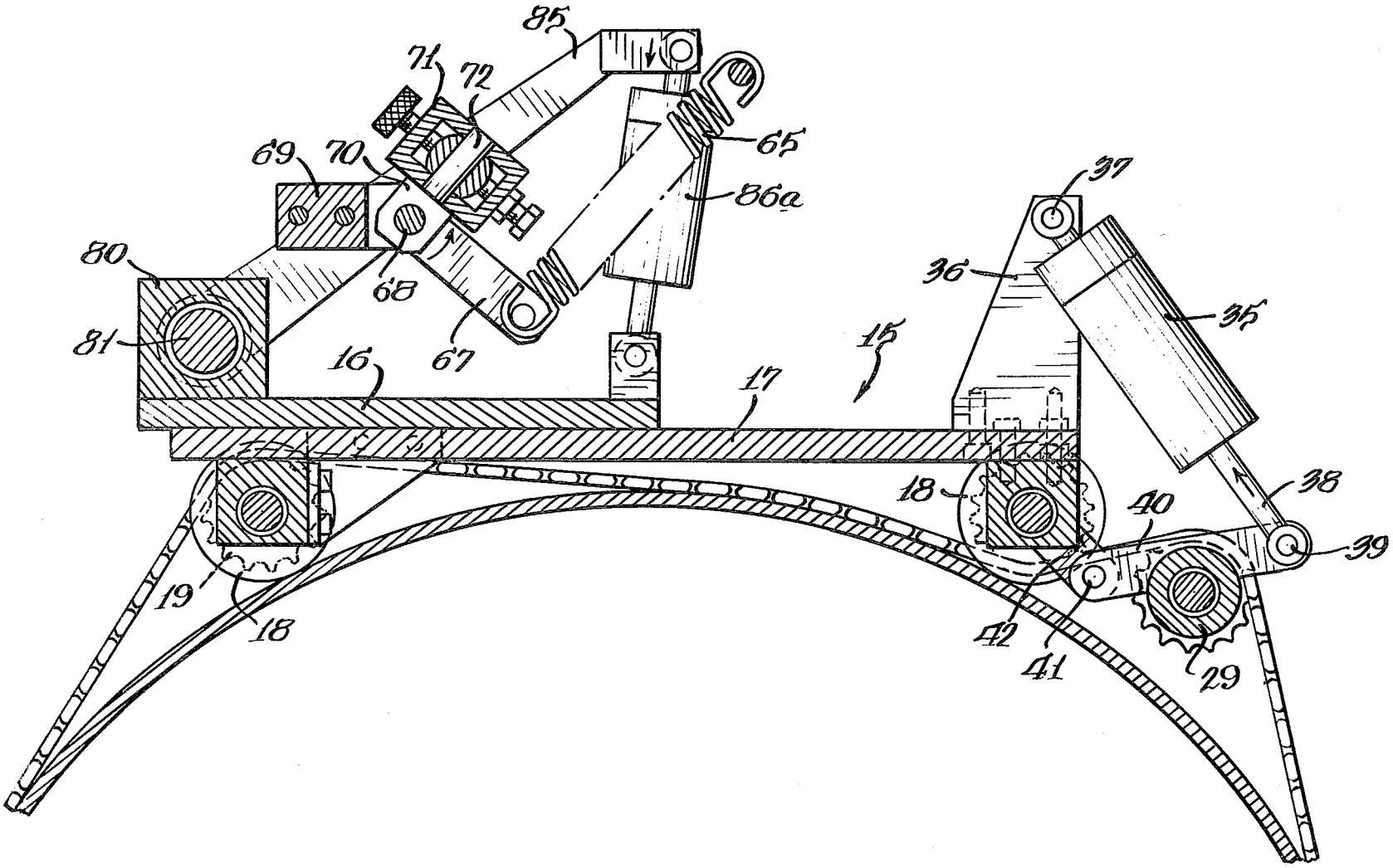
FIG. 5 is a vertical section, taken generally along the line 5—5 in FIG. 4.

The weld sander has a carriage, indicated generally at 15, which is constructed for travel around the pipe 11 by generally conventional type structure known in the art with respect to pipe cutting machines. The carriage has a base, formed from a pair of interconnected and overlapped plates 16 and 17, from which depend a plurality of combined rollers and sprockets, each having a roller 18 which engages the surface of the pipe 11 and a sprocket 19 which engages a sprocket chain fitted around the pipe. As seen in FIGS. 1 and 2, there are a pair of sprocket chains 20 and 21 fitted around the pipe 11 and the combination roller 18 and sprocket 19 is located one at each of the four corners of the carriage base for coaction with the pipe and the sprocket chains. Travel motion for the carriage circumferentially of the pipe is derived from a motor 25, shown in FIG. 3, which has an output shaft with a worm gear 26 meshing with a gear 27 fixed to a shaft 28 which is rotatably journalled in a sleeve 29. The shaft 28 has drive sprockets 30 and 31 at opposite ends thereof for engagement with the drive chains 21 and 20, respectively. Tension is maintained on the drive chains 20 and 21 by spring structure within a housing 35 which is pivotally connected to brackets 36 extending upwardly from the base 15 by a pivot pin 37. A rod 38 is spring-urged inwardly of the housing and is pivotally connected at 39 to an arm 40 mounting the sleeve 29 and which is pivoted at 41 to a bracket 42 secured to the underside of the base 15 of the carriage.

From the foregoing, it is evident that the carriage 15 can move circumferentially around the pipe 11 under the control of a drive including the selectively operable motor 25.

The abrading element for smoothing the surface of the weld 12 is a grinding belt 45 which travels around a driven back-up roller 46 with a resilient surface 47 and an idler roller 48. This structure is shown generally in FIGS. 1 and 3 and, particularly, in FIG. 6. A vercially-extending mounting plate 50 mounts a tubular bearing housing 51 in which a drive shaft 52 for the driven back-up roller 46 is rotatably mounted by bearings 53 and 54. The drive shaft 52 has a gear 55 fixed to an end thereof which meshes with idler geat 56 mounted on the mounting plate 50. The idler gear 56 is driven by a gear 57 mounted on output shaft 58 of a motor 59 mounted on the mounting plate 50. Operation of the motor 59 causes rotation of the back-up roller 46 through the drive gears 55–57.

The idler roller 48 is rotatably mounted on a shaft 60 by means of bearings 61. The idler roller 48 can move relative to the back-up roller 46 to provide for belt replacement and a positioning for holding the belt taut during travel thereof. The taut condition is maintained by a spring 65 extended between a bracket 66 extending upwardly from the mounting plate 50 and an arm 67 pivotally mounted at 68 to a bracket 69 fixed to the mounting plate 50. The arm 67 is fixed to a second arm 70 which mounts a hollow housing 71 into which an end of the mounting shaft 60 for the idler roller 48 extends and which is pivotally mounted within the housing 71 by a pivot pin 72. With this construction, the spring 65 urges the idler roller 48 away from the back-up roller 46 to maintain the belt 45 taut on the rollers. The angle of the idler roller 48 can be varied for maintaining the belt tracking properly on the rollers. This is done by operation of the adjustment screws 73 and 74 which thread into the housng 71 and abut against opposite sides of a flattened part of the mounting shaft 60 whereby threaded adjustment of these members can vary the angle of the idler roller 48 relative to pivoting of the mounting shaft 60 about the pivot pin 72.

The mounting plate 50 constitutes a head for support of the grinding belt and the head is mounted relative to the carriage 15 to provide for movement of the grinding belt toward and away from the weld 12 as well as tilting movement of the belt. The base plate 16 of the carriage 15 mounts a journal block 80 which rotatably mounts a shaft 81 having a stem 82 extending therefrom at a right angle. The stem 82 rotatably mounts a block 83 having a plate 84 to which the mounting plate 50 is attached. An arm 85 is fixed to a reduced diameter portion 86 of the shaft 81. A spring structure enclosed within a cylinder **86*a* operates to urge rod 87 inwardly of the cylinder. The rod, by means of a pin 88, is connected to the arm 85 to rotate the arm in a counterclockwise direction as viewed in FIG. 2 to urge the head and, therefore, the grinding belt 45 toward the weld 12**.

The block 83, being rotatably mounted on the stem 82, provides for rotation of the head about an axis of rotation which extends lengthwise of the weld 12 and which is located equidistant from the edges of the belt 45 as well as a pair of pipe follower rollers to be described.

Figure 6:
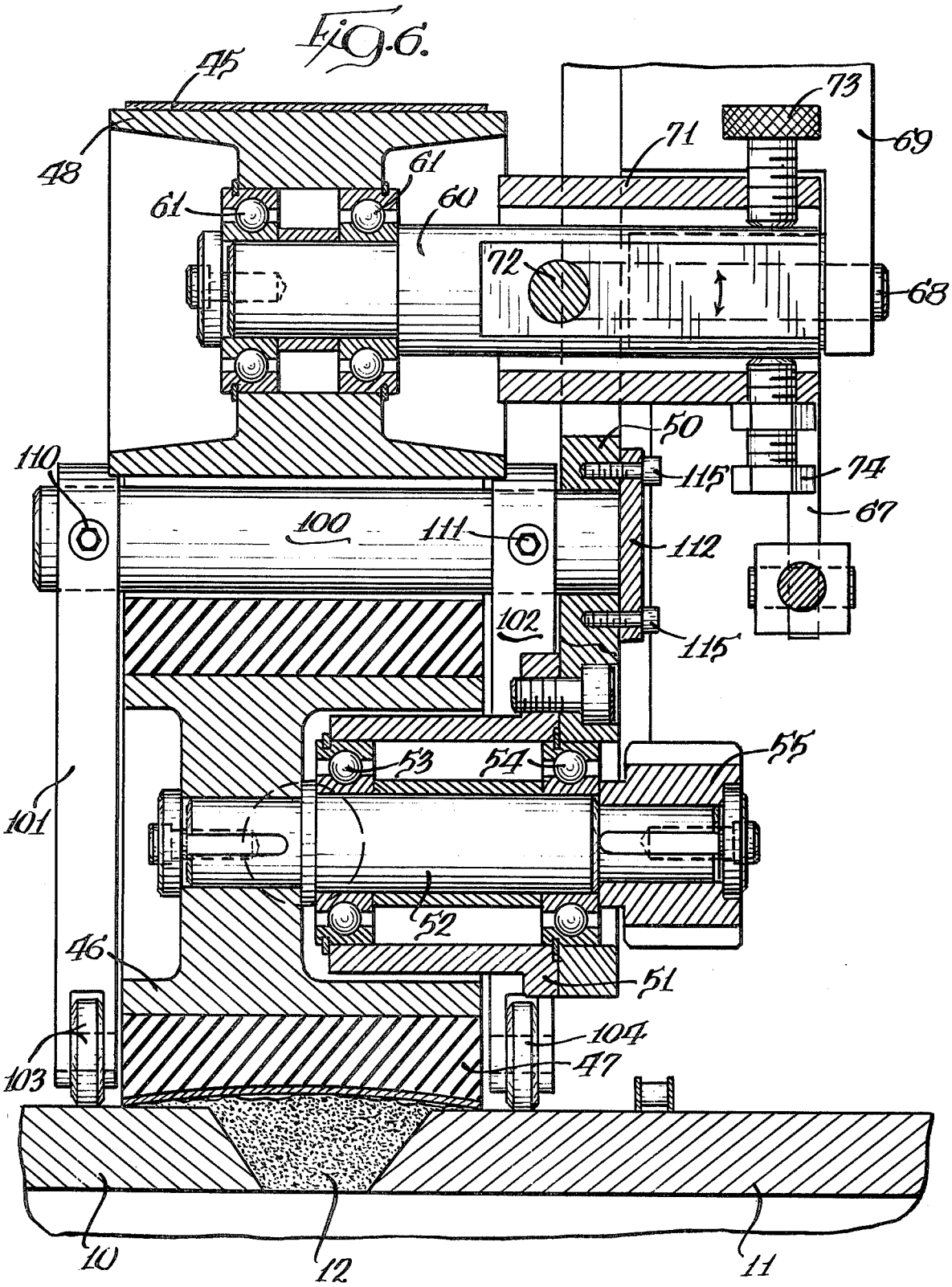
FIG. 6 is a sectional view, taken generally along the line 6—6 in FIG. 3 and on an enlarged scale.

A stem 100 extends outwardly from the mounting plate 50 (FIG. 6) and has a pair of depending arms 101 and 102 fixed thereto which extend downwardly toward the surface of the pipes. Each of these arms has a pipe follower roller 103 and 104, respectively, rotatably mounted at the lower end thereof and which engage the surface of the respective pipes 10 and 11, as seen in FIG. 6. These pipe follower rollers establish a minimum distance between the surface of the grinding belt 45 and the surface of the pipes 10 and 11. The pipe follower rollers 103,104 assure that the grinding belt stays a certain distance from the surface of the pipes 10 and 11. If, during the operation, there is a misalignment between the pipes 10 and 11, this can result in a canting of the grindng belt 45, which is a combination of the tilting movement of the grinding belt about the rotational axis defined by the stem 82 and a movement of the head away from the surface of the pipes by rotation of the shaft 81 within the journal block 80. The minimum distance between the belt and the pipe surfaces is maintained, even when the grinding belt is canted so that there can be no contact of the grinding belt with the exterior surfaces of the pipes. The arms 101 and 102 are fixed to a mounting stem 100 by threaded members 110 and 111 keyed to the stem. The stem has a flange 112 with elongate slots through which bolts 115 extend and thread into the mounting plate 50. This enables rotational adjustment of the mounting stem 100 and adjustment of the follower rollers 103 and 104 relative to the head to vary the minimum distance of the belt from the pipes.

We claim:

1. A weld sander having a carriage movable circumferentially around a length of pipe adjacent a circumferential weld connecting an end of said pipe to another pipe, a grinding belt for operation on said weld, means mounting said grinding belt relative to said carriage for movement toward and away from said weld and for tilting movement aout an axis extending parallel to and spaced from the length of the grinding belt, said axis being approximately equidistant from the edges of the belt, and pipe follower means for limiting movement of the grinding belt toward the weld and for establishing a minimum distance between edges of the belt and the pipes when the belt tilts.

2. A weld sander as defined in claim 1 wherein said belt has a width greater than the width of the weld and said pipe follower means comprises a pair of rollers positioned one adjacent each edge of said belt.

3. A weld sander as defined in claim 2 wherein said belt is carried on a head, and said rollers are adjustably mounted on said head.

4. A weld sander as defined in claim 3 wherein said head is positioned to one side of said carriage, said means mounting the grinding belt for movement toward and away from the weld comprises a pivot mounting of the head to the carriage, and force-applying means for urging the head and belt toward the weld.

5. A weld sander for finishing a weld between pipe sections preparatory to weld inspection comprising, a frame having means for guided movement along a path circumferentially around a pipe section, means for advancing said frame along said path, a head positioned adjacent said frame and carrying a grinding belt for engagement with said weld, a journal block on said frame, an L-shaped member having a pair of arms at right angles to each other movably interconnecting said head to the frame, one of said arms being rotatable in said journal block about an axis for movement of the head toward and away from the weld, the head being rotatable on the other arm of the L-shaped member for rotation about an axis extending parallel to and spaced from said grinding belt for tilting of the grinding belt transversely of the weld, said axis being approximately equidistant from the edges of the belt, and a pair of rollers extending from said head at opposite sides of said last-mentioned axis and said grinding belt for engagement with said pipe sections at opposite sides of the weld to maintain a minimum distance between the pipe sections and the grinding belt in all tilted positions of the grinding belt.

6. A weld sander as defined in claim 5 including means acting on said one arm of the L-shaped member urging the head and grinding belt toward the pipe sections.

* * * * *